US009315015B2

(12) United States Patent
Kim et al.

(10) Patent No.: US 9,315,015 B2
(45) Date of Patent: Apr. 19, 2016

(54) PRINTED MATERIAL FIXING PIECE, PRINTING DEVICE, AND PRINTING METHOD

(71) Applicant: LG CHEM, LTD., Seoul (KR)

(72) Inventors: Jooyeon Kim, Daejeon (KR); Seung Heon Lee, Daejeon (KR); Dae Hyun Kim, Daejeon (KR); Wonjoo Lee, Daejeon (KR)

(73) Assignee: LG CHEM, LTD., Seoul (KR)

( * ) Notice: Subject to any disclaimer, the term of this patent is extended or adjusted under 35 U.S.C. 154(b) by 0 days.

(21) Appl. No.: 14/365,029

(22) PCT Filed: Jul. 5, 2013

(86) PCT No.: PCT/KR2013/006016
§ 371 (c)(1),
(2) Date: Jun. 12, 2014

(87) PCT Pub. No.: WO2014/010887
PCT Pub. Date: Jan. 16, 2014

(65) Prior Publication Data

US 2014/0338551 A1 Nov. 20, 2014

(30) Foreign Application Priority Data

Jul. 10, 2012 (KR) ..... 10-2012-0074993

(51) Int. Cl.
*B41F 1/28* (2006.01)
*B41F 21/06* (2006.01)
*B41M 1/06* (2006.01)

(52) U.S. Cl.
CPC . *B41F 21/06* (2013.01); *B41M 1/06* (2013.01)

(58) Field of Classification Search
CPC ..... B41F 27/005; B41F 27/08
USPC ..... 101/407.1
See application file for complete search history.

(56) References Cited

U.S. PATENT DOCUMENTS

| | | | | |
|---|---|---|---|---|
| 4,491,072 | A * | 1/1985 | Berberich | B41F 27/08 101/327 |
| 4,727,806 | A * | 3/1988 | Green, Sr. | B41F 27/005 101/415.1 |
| 4,743,324 | A * | 5/1988 | Boyce | B41F 27/005 101/494 |
| 6,148,728 | A * | 11/2000 | Shin et al. | 101/483 |
| 6,854,418 | B2 * | 2/2005 | Asai et al. | 118/37 |
| 7,430,962 | B2 * | 10/2008 | Kim et al. | 101/389.1 |
| 8,281,715 | B2 * | 10/2012 | Lehner | B41J 3/28 101/35 |
| 2008/0202365 | A1 | 8/2008 | Schneider et al. | |
| 2008/0236425 | A1 | 10/2008 | Takamatsu | |
| 2010/0206194 | A1 * | 8/2010 | Lehner et al. | 101/474 |
| 2010/0264567 | A1 | 10/2010 | Kim | |

(Continued)

FOREIGN PATENT DOCUMENTS

| | | |
|---|---|---|
| JP | 2005-243896 A | 9/2005 |
| JP | 2007-268715 A | 10/2007 |

(Continued)

*Primary Examiner* — Anthony Nguyen
(74) *Attorney, Agent, or Firm* — Dentons US LLP

(57) ABSTRACT

The present application relates to an apparatus for fixing a printed matter including a plurality of engraved portions which may fix a plurality of printed matters, and at least one vacuum hole or vacuum passage provided at a lower portion of the engraved portion, a printing device including the apparatus for fixing a printed matter, and a printing method using the apparatus for fixing a printed matter.

17 Claims, 8 Drawing Sheets

(56) References Cited

U.S. PATENT DOCUMENTS

| | | | | |
|---|---|---|---|---|
| 2011/0041716 | A1* | 2/2011 | Willshere | B41F 15/08 101/407.1 |
| 2012/0125215 | A1* | 5/2012 | Cho et al. | 101/425 |

FOREIGN PATENT DOCUMENTS

| | | | |
|---|---|---|---|
| JP | 2008-246829 | A | 10/2008 |
| JP | 4289184 | B2 | 4/2009 |
| JP | 2010-056182 | A | 3/2010 |
| JP | 2014-012361 | A | 1/2014 |
| KR | 10-2007-0120674 | A | 12/2007 |
| KR | 10-2008-0005391 | A | 1/2008 |
| KR | 10-2009-0056131 | A | 6/2009 |
| KR | 10-2010-0009919 | A | 1/2010 |
| KR | 10-2012-0014707 | A | 2/2012 |
| KR | 10-2012-0028579 | A | 3/2012 |

* cited by examiner

PRINTED MATERIAL FIXING PIECE, PRINTING DEVICE, AND PRINTING METHOD

This application is a 35 USC §371 National Stage entry of International Application No. PCT/KR2013/006016, filed Jul. 5, 2013, and claims priority to Korean Application No. 10-2012-0074993 filed Jul. 10, 2012, each of which are hereby incorporated by reference in its entirety.

TECHNICAL FIELD

The present application relates to an apparatus for fixing a printed matter, a printing device including the same and a printing method including the same.

BACKGROUND ART

Recently, patterns of various functional materials are required for an electronic device. For example, a conductive pattern for an electrode, a black matrix pattern and a color pattern for a color filter, an insulating pattern and a resist pattern for a thin film transistor (TFT), and the like are required.

The patterns may be formed by a photolithography method, and the like, but a pattern forming method using a printing method has been attempted in consideration of process costs or efficiency.

In the printing method, there are various problems to be solved in advance, such as an alignment problem for forming a precise pattern at an exact position of a printed matter, requirements for increasing process efficiency, and requirements for reducing costs.

DISCLOSURE

Technical Problem

The present application has been made in an effort to provide a printing method and a printing device, which may improve process efficiency by forming a precise electronic material pattern, or forming a pattern on a plurality of printed matters in one printing.

Technical Solution

An exemplary embodiment of the present application provides an apparatus for fixing a printed matter including a plurality of engraved portions which may fix a plurality of printed matters, and at least one vacuum hole or vacuum passage provided at a lower portion of the engraved portion.

Another exemplary embodiment of the present application provides a printing device including the apparatus for fixing a printed matter.

Still another exemplary embodiment of the present application provides a printing method using the apparatus for fixing a printed matter.

Advantageous Effects

The apparatus for fixing a printed matter according to an exemplary embodiment of the present application may efficiently fix and align the printed matter when mounting the printed matter on a printed matter stage, and may fix one or more printed matters on one apparatus for fixing a printed matter, and thus is advantageous in that patterns may be formed on a plurality of printed matters in one printing.

Therefore, there is an advantage in that the precision of the printing pattern is enhanced, the process efficiency is improved, and process costs are reduced.

MODE FOR INVENTION

Figure 1:
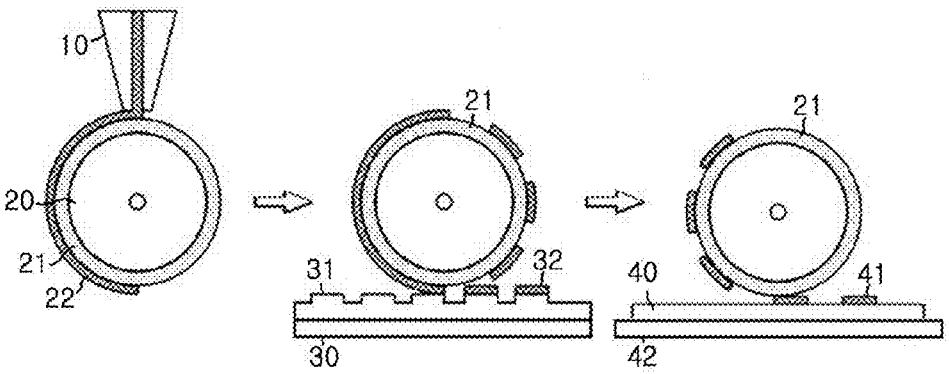
FIG. 1 illustrates a reverse offset printing process.

The advantages and features of the present application, and methods of accomplishing the advantages and features will become obvious with reference to exemplary embodiments to be described below in detail along with the accompanying drawings. However, the present application is not limited to the exemplary embodiments to be disclosed below, but will be implemented in various forms different from each other. The exemplary embodiments are merely intended to make the disclosure of the present application complete and to completely notify the person with ordinary skill to which the present application pertains of the scope of the invention, and the present application is only defined by the scope of the claims. The size and relative size of the constituent elements marked in the drawings may be exaggerated for clarity of description. Hereinafter, the description made with reference to the accompanying drawings will be provided for illustrative purposes only, and the scope of the present application is not limited thereby.

Unless otherwise defined, all terms including technical and scientific terms used in the present specification may be used as the meaning which may be commonly understood by the person with ordinary skill in the art to which the present application pertains. Terms defined in commonly used dictionaries should not be interpreted in an idealized or excessive sense unless clearly and particularly defined.

Hereinafter, the present application will be described in detail.

An exemplary embodiment of the present application provides an apparatus for fixing a printed matter 100 used in a printing device. The apparatus for fixing a printed matter 100 may include a plurality of engraved portions 110 which may fix a plurality of printed matters; and at least one vacuum hole 122 and/or at least one vacuum passage 124 provided at a lower portion of the engraved portion 110. The apparatus for fixing a printed matter 100 may fix a printed matter 40 at each engraved portion 110.

Specifically, the apparatus for fixing a printed matter 100 may include two or more engraved portions 110 which may fix two or more printed matters; and at least one vacuum hole 122 and/or a least one vacuum passage 124 provided at a lower portion of the engraved portion 110. Thus, one apparatus for fixing a printed matter may fix two or more printed matters simultaneously, and thus is advantageous in that printing patterns may be formed on two or more printed matters in one printing.

Alternatively, the apparatus for fixing a printed matter 100 may include four or more engraved portions 110 which may fix four or more printed matters; and at least one vacuum hole 122 and/or at least one vacuum passage 124 provided at a lower portion of the engraved portion 110. Thus, one apparatus for fixing a printed matter may fix four or more printed matters simultaneously, and thus is advantageous in that printing patterns may be formed on four or more printed matters in one printing.

Alternatively, the apparatus for fixing a printed matter 100 may include six or more engraved portions 110 which may fix six or more printed matters; and at least one vacuum hole 122 and/or at least one vacuum passage 124 provided at a lower portion of the engraved portion 110. Thus, one apparatus for fixing a printed matter may fix six or more printed matters simultaneously, and thus is advantageous in that printing patterns may be formed on six or more printed matters in one printing.

Alternatively, the apparatus for fixing a printed matter 100 may include eight or more engraved portions 110 which may fix eight or more printed matters; and at least one vacuum hole 122 and/or at least one vacuum passage 124 provided at a lower portion of the engraved portion 110. Thus, one apparatus for fixing a printed matter may fix eight or more printed matters simultaneously, and thus is advantageous in that printing patterns may be formed on eight or more printed matters in one printing.

Alternatively, the apparatus for fixing a printed matter 100 may include nine or more engraved portions 110 which may fix nine or more printed matters; and at least one vacuum hole 122 and/or at least one vacuum passage 124 provided at a lower portion of the engraved portion 110. Thus, one apparatus for fixing a printed matter may fix nine or more printed matters simultaneously, and thus is advantageous in that printing patterns may be formed on nine or more printed matters in one printing.

One or two or more vacuum holes 122 and/or one or two or more vacuum passages 124 may be provided at a lower portion of each engraved portion 110.

Figure 2:
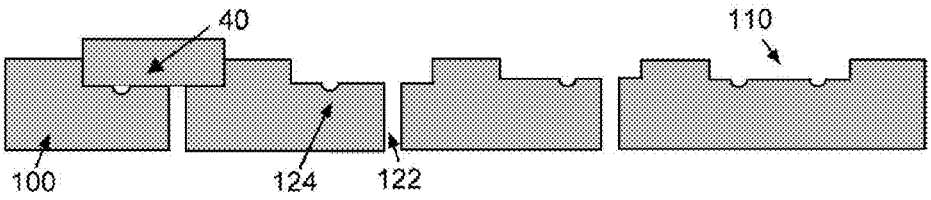
FIG. 2 illustrates a side view of an apparatus for fixing a printed matter according to an exemplary embodiment of the present application.
Figure 3:
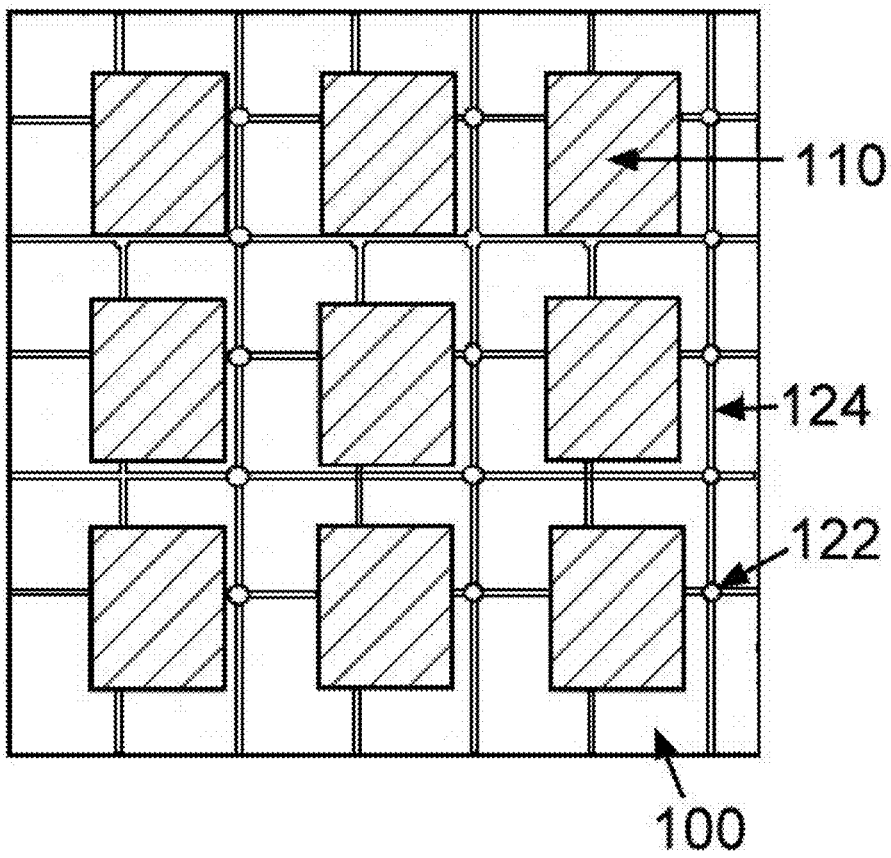
FIG. 3 illustrates a plan view of the apparatus for fixing a printed matter according to an exemplary embodiment of the present application when observed from above.

FIG. 2 illustrates a side view of the apparatus for fixing a printed matter according to an exemplary embodiment of the present application, and FIG. 3 illustrates a plan view of the apparatus when observed from above.

In the present specification, the printed matter 40 means a printing object on which a printing pattern is transferred or an object to be printed, and may be, for example, a substrate. Further, the substrate may be glass or plastic.

A printing process by which the apparatus for fixing a printed matter according to an exemplary embodiment of the present application is used may be a reverse offset printing process. FIG. 1 illustrates an exemplary embodiment of the reverse offset printing process. According to FIG. 1, a printing roll includes a printing roll stage 20 and a blanket 21 provided to cover the surface of the printing roll stage. A printing matter 22 is coated on a blanket 21 of the printing roll using a coating portion 10. Subsequently, a printing matter pattern 41 is formed on the blanket 21 by removing a part of a printing matter pattern 32 from the blanket 21 of the printing roll by bringing the blanket 21 of the printing roll in contact with a cliché 31 provided on a cliché stage 30. Subsequently, the printing matter pattern 41 is transferred on the printed matter 40 by bringing the blanket 21 of the printing roll in contact with the printed matter 40.

In an exemplary embodiment of the present application, the apparatus for fixing a printed matter 100 may be mounted on a printed matter stage 42. In the present specification, the printed matter stage 42 means a support portion of the printed matter, on which the printed matter may be placed.

The apparatus for fixing a printed matter according to an exemplary embodiment of the present application may be attached to and detached from a printed matter stage, and thus is advantageous in that it is facilitated to simultaneously form a plurality of printing patterns in one printing by fixing a plurality of printed matters.

In an exemplary embodiment of the present application, a printed matter 40 may be fixed to an upper portion of the apparatus for fixing a printed matter 100, and a printed matter stage 42 may be provided at a lower portion of the apparatus for fixing a printed matter.

In an exemplary embodiment of the present application, the vacuum hole 122 and/or vacuum passage 124 may be disposed at a lower portion of the engraved portion 110, and one or two or more vacuum holes 122 and/or vacuum passages 124 may be provided at a lower portion of one engraved portion 110. Alternatively, the vacuum hole 122 and/or vacuum passage 124 may also be disposed at a portion in which the engraved portion 110 is not present in the apparatus for fixing a printed matter 100.

FIGS. 2 and 3 illustrate the side structure of the vacuum hole 122 and the vacuum passage 124 disposed at a lower portion of the engraved portion 110 and a plan view thereof when observed from above. In order to increase efficiency of vacuum adsorption by the structure of the vacuum hole 122, the surface may include a structure of the vacuum passage 124 composed of a groove. Intersection points having a lattice form of the structure of the vacuum passage 124 composed of a groove may have a structure of a hole 122. The shape and diameter of the hole, or the shape, width and depth of the groove of the structure of the passage are not particularly limited as long as the printed matter 40 may be fixed to the apparatus for fixing a printed matter 100 without being deformed by the vacuum hole 122 and the vacuum passage 124.

For example, the diameter of the vacuum hole 122 may be one to 15 times the thickness of the printed matter, but is not limited thereto.

For example, the width of the vacuum passage 124 may be one to 10 times the thickness of the printed matter, but is not limited thereto.

In order to enhance the adsorption power thereof, the smaller a degree of vacuum of the vacuum adsorption is than normal pressure, the better the degree of vacuum is. At this time, vacuum refers to the state where pressure is lower than normal pressure (760 mmHg), and the degree of vacuum means a pressure of the remaining gas in a container under vacuum when compared to the state of vacuum with respect to normal pressure.

The degree of vacuum of the vacuum adsorption is not particularly limited as long as the printed matter may be fixed to the apparatus for fixing a printed matter without being deformed by the vacuum hole 122 and the vacuum passage 124.

For example, the degree of vacuum of the vacuum adsorption may be 5% or less of normal pressure. The degree of vacuum of the vacuum hole 122 and vacuum passage 124 may be 50 mmHg or less.

The lower limit of the degree of vacuum of the vacuum hole 122 and vacuum passage 124 is not particularly limited as long as the printed matter is not deformed by the vacuum hole 122 and vacuum passage 124 according to the type and thickness of the printed matter used.

Figure 4:
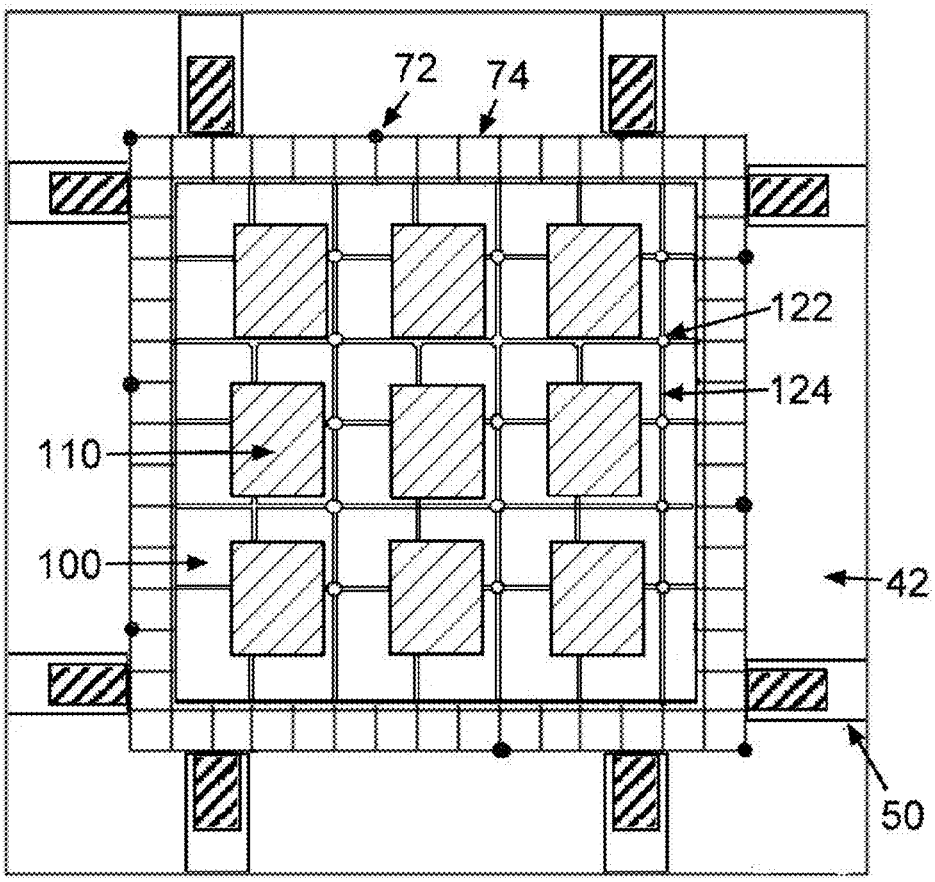
FIG. 4 illustrates that the apparatus for fixing a printed matter according to an exemplary embodiment of the present application is mounted on a printed matter stage with a plan view when observed from above.
Figure 5:
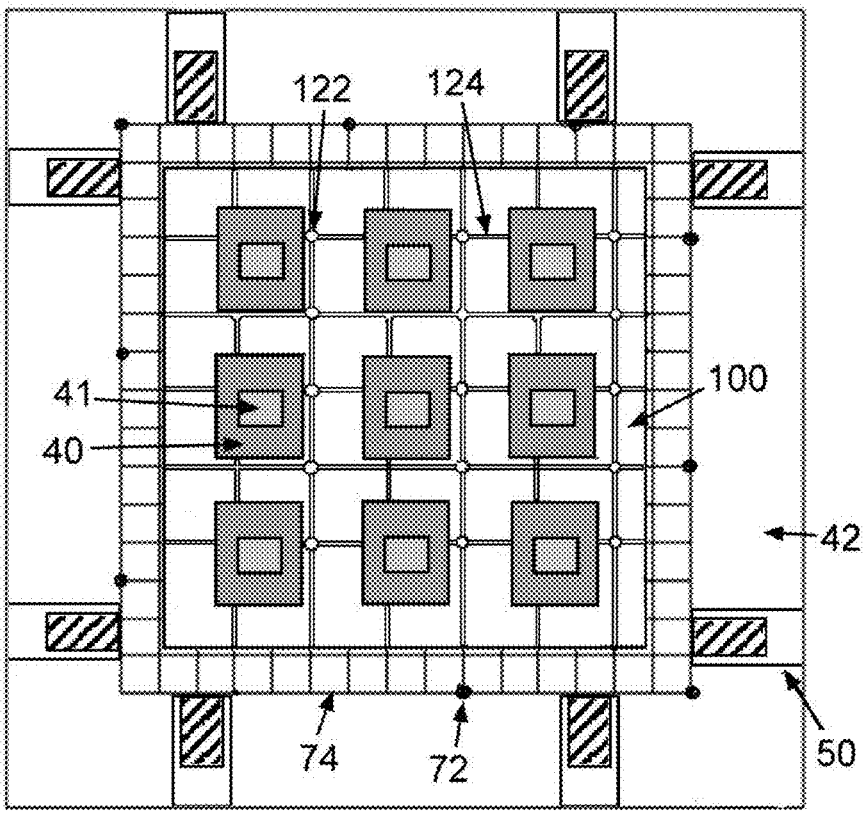
FIG. 5 illustrates that a printed matter is fixed to the apparatus for fixing a printed matter according to an exemplary embodiment of the present application and thus is mounted on a printed matter stage with a plan view when observed from above.

FIG. 4 illustrates that the apparatus for fixing a printed matter 100 according to an exemplary embodiment of the present application is mounted on a printed matter stage 42 with a plan view when observed from above, and FIG. 5 illustrates that a printed matter 40 is fixed to the apparatus for fixing a printed matter 100 according to an exemplary embodiment of the present application and thus is mounted on a printed matter stage 42 with a plan view when observed from above.

In an exemplary embodiment of the present application, the engraved portion 110 is disposed at an upper portion of the apparatus for fixing a printed matter 100, and may be formed such that the printed matter may be arranged and installed. The engraved portion 110 may include a projection or groove for fixing a printed matter at the inner side thereof. The shape of the projection or groove is not particularly limited as long as the shape has a structure capable of facilitating the fixation of the printed matter 40. For example, the shape of the cross-section of the projection or groove may be a circular, triangular, quadrangular, or trapezoidal shape.

In an exemplary embodiment of the present application, the depth of the engraved portion 110 may be equal to or smaller than the thickness of the printed matter 40. When the depth of the engraved portion 110 is larger than the thickness of the printed matter 40, it is difficult to vacuum-adsorb the apparatus for fixing a printed matter 100 to the printed matter stage 42 because there is no place where the vacuum hole 122 and the vacuum passage 124 are formed.

In an exemplary embodiment of the present application, the depth deviation of the engraved portion 110 may be 100 μm or less. Specifically, the deviation between depths of a plurality of engraved portions 110 may be 100 μm or less. When the depth deviation of the engraved portion 110 is 100 μm or less, the precision of the level difference between printed matters is improved when the printed matter 40 is fixed, and thus, the precision of the printing pattern 41 printed on the printed matter 40 is also good.

In an exemplary embodiment of the present application, the printed matter stage 42 may further include a position control portion 50 for aligning the printed matter.

In an exemplary embodiment of the present application, the position control portion of the printed matter stage may control a position on a plane. For example, the position control portion of the printed matter stage may have a configuration in which a microscopic position of the printed matter stage is controlled to three positions, that is, a position in the x direction, a position in the y direction, and a position in the theta (θ) direction. Here, when the x direction is defined as any one direction on a plate surface of the printed matter stage, for example, as a transverse direction of the printed matter stage, y means a direction vertical to the x direction on the plate surface of the printed matter stage, for example, a longitudinal direction of the printed matter stage, and the theta (θ) direction means an angle on the plate surface of the printed matter stage. As described above, the configuration is not particularly limited as long as the position on the plane of the printed matter stage may be controlled.

In an exemplary embodiment of the present application, the printed matter stage 42 may include a vacuum suction portion 70 corresponding to the vacuum hole 122 and vacuum passage 124 of the engraved portion 110. The structure of the vacuum passage 124 of the apparatus for fixing a printed matter 100 corresponds to the structure of the vacuum passage 74 of the printed matter stage 42. In addition, the structure of the vacuum hole 122 of the apparatus for fixing a printed matter 100 may be connected under vacuum to the structure of the vacuum hole 72 of the printed matter stage 42 in correspondence therewith, and fixed thereto.

In an exemplary embodiment of the present application, the printed matter stage 42 may be provided with a porous plate 62 or a porous film 64. As long as the porous plate and the porous film may prevent the printed matter from being damaged while having a porous structure capable of achieving vacuum suction by the vacuum suction portion, the structure, form, material and the like thereof are not limited.

The porous plate 62 and the porous film 64 may be selected by those skilled in the art in consideration of the type and the like of the printed matter. For example, the porous plate 62 or the porous film 64 may have an average pore size of 100 μm or less, specifically, 30 or less. The lower limit of the average pore size of the porous plate 62 or the porous film 64 is not particularly limited as long as air may pass through the porous plate 62 or the porous film 64, and may be, for example, 10 nm or more.

The larger the porosity is, the better the porous plate 62 or the porous film 64 is. Specifically, the porosity may be 10% or more.

Figure 6:
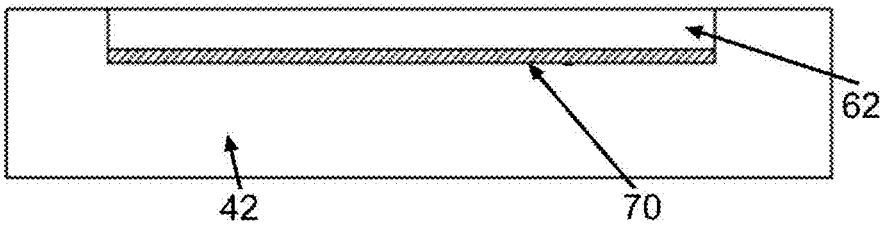
FIGS. 6 and 7 illustrate a side view of a printed matter stage of a printing device according to an exemplary embodiment of the present application.
Figure 7:
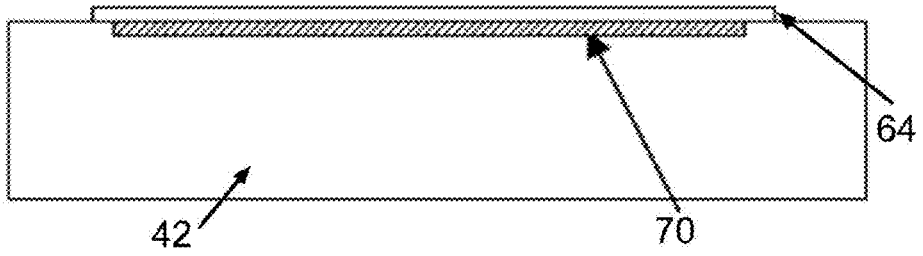

In an exemplary embodiment of the present application, the porous plate 62 or the porous film 64 may be provided at an upper portion of the vacuum suction portion 70. FIGS. 6 and 7 illustrate a side view of a printed matter stage 42 in a printing device according to an exemplary embodiment of the present application.

Figure 8:
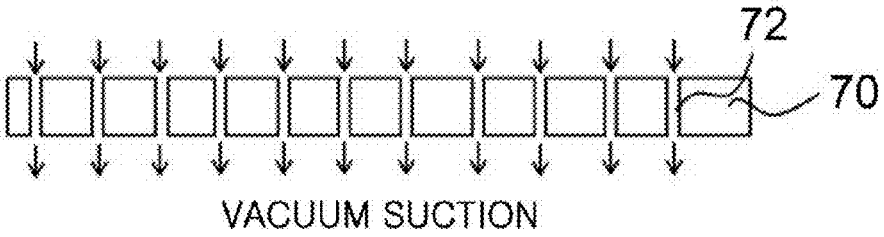
FIGS. 8 and 9 illustrate a side view of a vacuum suction portion of the printed matter stage of the printing device according to an exemplary embodiment of the present application.
Figure 9:
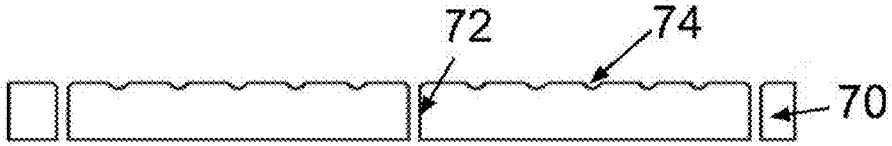
Figure 10:
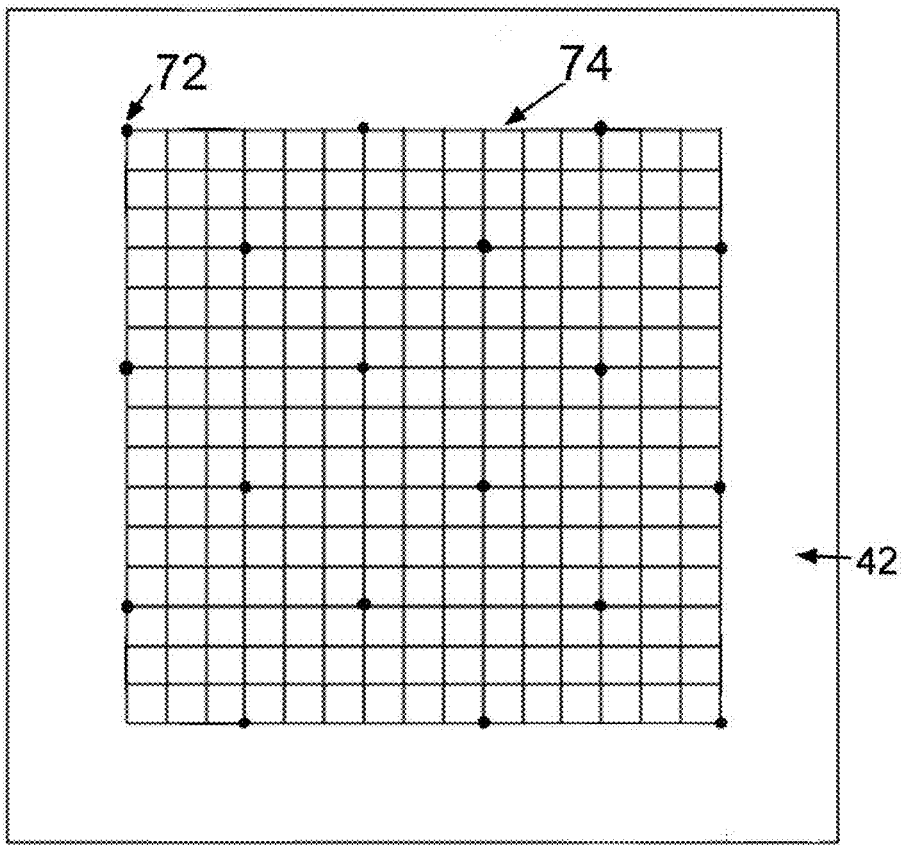
FIGS. 10 and 11 illustrate a plan view of the printed matter stage of the printing device according to an exemplary embodiment of the present application.
Figure 11:
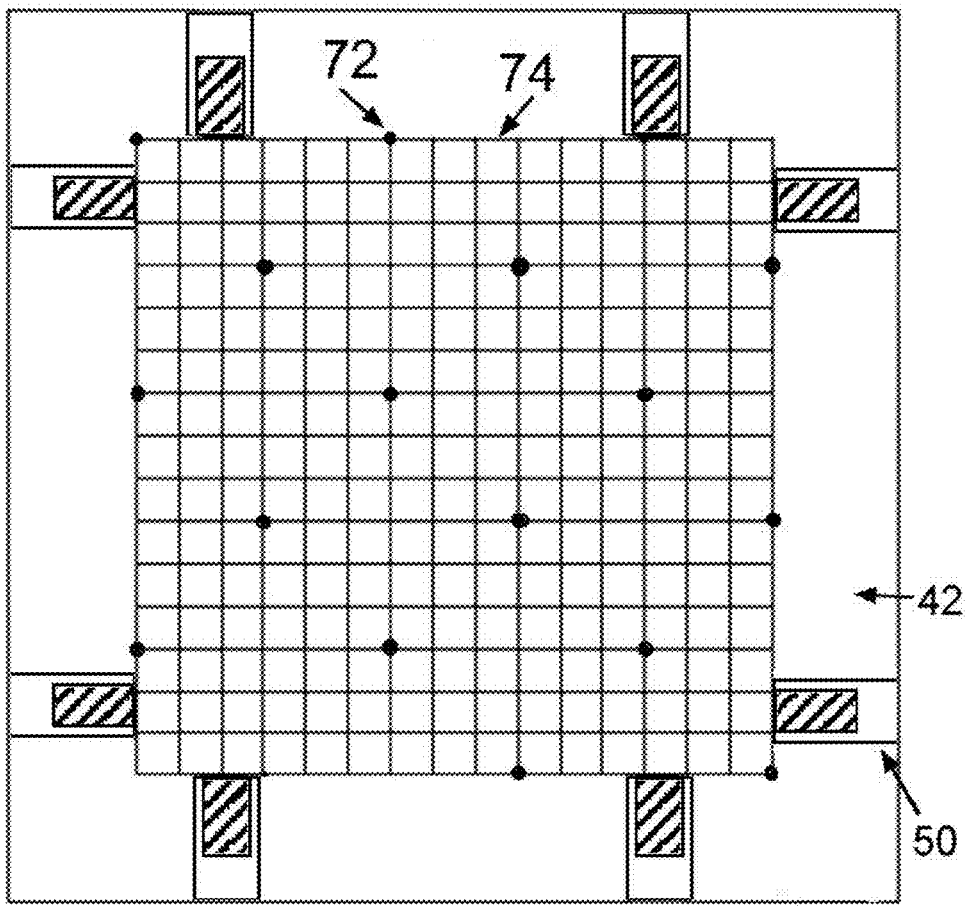

In an exemplary embodiment of the present application, the vacuum suction portion 70 is necessary for alignment, which is necessary for controlling the position of a precise pattern and performing a superimposed printing. The vacuum suction portion 70 may include the structure of a vacuum hole 72 or the structure of a vacuum passage 74, which is capable of achieving vacuum suction. FIGS. 8 and 9 illustrate a side view of a vacuum suction portion 70 of the printed matter stage 42 of the printing device according to an exemplary embodiment of the present application. FIGS. 10 and 11 illustrate a plan view of the printed matter stage of the printing device according to an exemplary embodiment of the present application when observed from above.

The description on the structure of the vacuum hole 72 or vacuum passage 74 of the vacuum suction portion 70 is the same as described in the vacuum adsorption portion.

When the apparatus for fixing a printed matter 100 according to an exemplary embodiment of the present application is used in a printing process, there is an advantage in terms of alignment of the printed matter and the printed matter stage 42. Since the printed matter is fixed to the apparatus for fixing a printed matter 100, it is easier to mount the printed matter on the printed matter stage 42, and it is easy to align the printed matter. Furthermore, since it is easy to align the printed matter, it is more efficient to form a microscopic and precise printing pattern.

Further, since a plurality of printed matters 40 may be fixed to one apparatus for fixing a printed matter 100, printing patterns may be formed on a plurality of printed matters 40 in one printing. Therefore, there is an effect that process efficiency is excellent and the process cost is reduced.

Another exemplary embodiment of the present application provides a printing device including the apparatus for fixing a printed matter 100.

The printing device may be a reverse offset printing device.

In an exemplary embodiment of the present application, the printing device may further include a cliché 31 including a pattern portion corresponding to the pattern position of the printed matter 40 which may be fixed on the apparatus for fixing a printed matter 100; and a cliché stage 30. In the present specification, the cliché stage means a cliché support portion on which the cliché 31 may be mounted.

In an exemplary embodiment of the present application, the cliché 31 may include two or more alignment marks. The form of the alignment mark is transferred on the printed matter by a printing composition. The alignment mark is regardless of the size or form as long as the position of the cliché 31 may be sensed such that the position of the cliché 31 may be controlled according to the degree of alignment. The alignment mark formed on the cliché 31 may be engraved or embossed based on the form to be transferred on the printed matter 40.

When there are two or more alignment marks, it is possible to exactly catch the disposed position of the cliché 31, and three or four or more alignment marks may also be included, if necessary. Since the alignment mark is for indicating the position, the size or form of the alignment mark is not particularly limited as long as the alignment mark may be sensed by a means for sensing the alignment mark, for example, a camera. Even when an opaque material is used as a printed matter by forming the alignment mark on the cliché substrate as described above, it is possible to implement an alignment with high accuracy.

In this case, the cliché stage 30 may additionally include an alignment camera for recognizing an alignment mark on the cliché 31 and a position control portion of the cliché stage 30. The position control portion of the cliché stage 30 may control a position on a plane. For example, the position control portion of the cliché stage 30 may have a configuration in which a microscopic position of the cliché stage 30 is controlled to three positions, that is, a position in the x direction, a position in the y direction, and a position in the theta (θ) direction. Here, when the x direction is defined as any one direction on a plate surface of the cliché stage 30, for example, as a transverse direction of the cliché stage 30, y means a direction vertical to the x direction on the plate surface of the cliché stage 30, for example, a longitudinal direction of the cliché stage 30, and the theta (θ) direction means an angle on the plate surface of the cliché stage 30. As described above, the configuration is not particularly limited as long as the position on the plane of the cliché stage 30 may be controlled.

Figure 12:
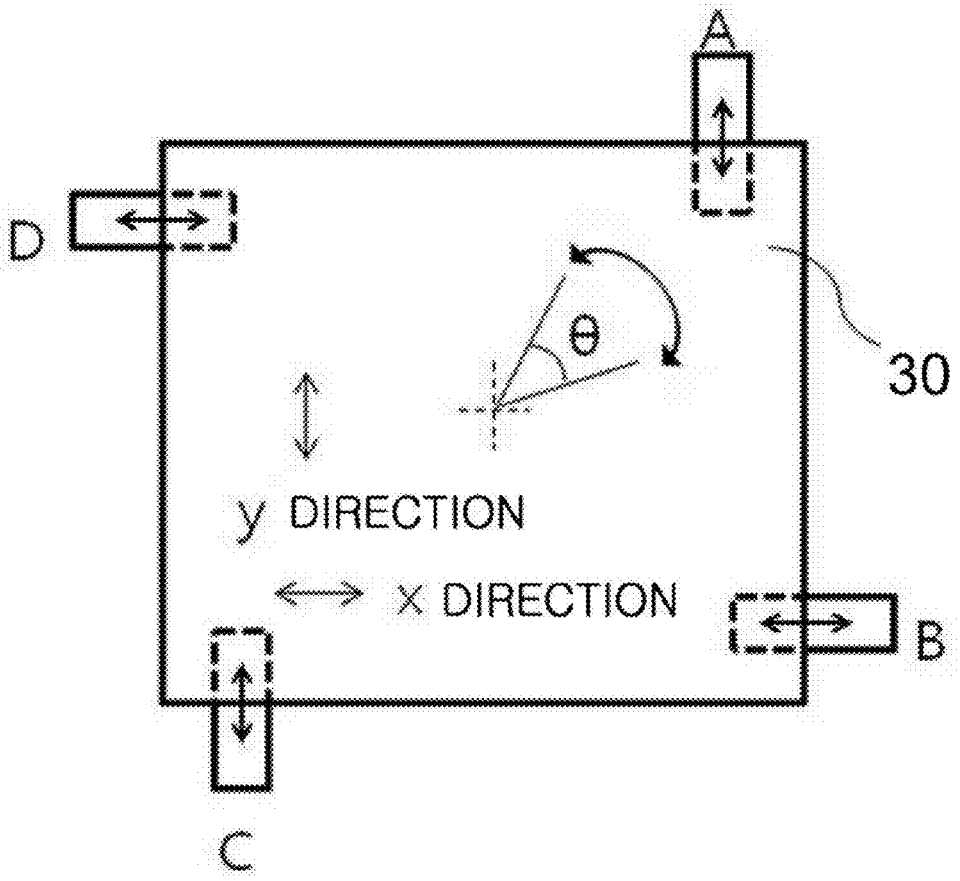
FIG. 12 illustrates an example of operating a position control portion of a stage for mounting a cliché according to an exemplary embodiment of a printing device according to the present application.

FIG. 12 illustrates an example of the position controlling method of the cliché stage 30. The position control portion of the cliché stage 30 includes A, B, C, and D. A, B, C, and D are each provided in the vicinity of each vertex of the cliché stage 30 and move in an arrow direction indicated as the red color, thereby controlling the position of the cliché stage 30.

In an exemplary embodiment of the present application, the printing device may further include a printed matter stage 42 on which the apparatus for fixing a printed matter 100 may be mounted. The description on the printed matter stage 42 is the same as described above.

The printing device according to an exemplary embodiment of the present application may be used for printing various patterns necessary for various electronic devices on a printed matter. The printed matter may also be used as a flexible substrate in an electronic device, for example, a touch panel, various displays, and the like, and may be used as a film member in addition to the flexible substrate. For example, the printed matter may be used for printing a conductive pattern, an insulating pattern, a resist pattern, a color pattern, a black matrix pattern, and the like.

The printed matter according to an exemplary embodiment of the present application may have a printing pattern having a line width and a pitch, which are necessary according to the use thereof. For example, the printed matter may have a printing pattern with a line width of 120 μm or less, specifically, from 1 μm to 120 μm. As an example, the printing film may include a printing pattern with a line width from 1 μm to 5 μm, or from 15 μm to 100 μm.

An exemplary embodiment of the present application provides a printing method using the apparatus for fixing a printed matter.

The printing method according to an exemplary embodiment of the present application may include: fixing a printed matter to an engraved portion of the apparatus for fixing a printed matter; mounting the apparatus for fixing a printed matter on a printed matter stage; vacuum adsorbing the apparatus for fixing a printed matter and the printed matter stage; and printing a pattern on the printed matter.

In the printing method according to an exemplary embodiment of the present application, the sequence of the step of fixing the printed matter to the engraved portion of the apparatus for fixing a printed matter and the step of mounting the apparatus for fixing a printed matter on the printed matter stage is not particularly limited.

The printing method according to an exemplary embodiment of the present application may fix a printed matter to an engraved portion of an apparatus for fixing a printed matter, and then mount the apparatus for fixing a printed matter on a printed matter stage, or may mount the apparatus for fixing a printed matter on the printed matter stage, and then fix the printed matter to the engraved portion of the apparatus for fixing a printed matter.

In an exemplary embodiment of the present application, the printing method may be a reverse offset printing method.

The printing method according to an exemplary embodiment of the present application may further include aligning the apparatus for fixing a printed matter and the printed matter stage after mounting the apparatus for fixing a printed matter on the printed matter stage.

In the printing method according to an exemplary embodiment of the present application, when aligning the apparatus for fixing a printed matter and the printed matter stage and vacuum adsorbing the apparatus for fixing a printed matter and the printed matter stage are all performed, the sequence thereof is not particularly limited.

In an exemplary embodiment of the present application, the apparatus for fixing a printed matter and the printed matter stage may be aligned, and then the apparatus for fixing a printed matter and the printed matter stage may be vacuum adsorbed, or the apparatus for fixing a printed matter and the printed matter stage may be vacuum adsorbed, and then the apparatus for fixing a printed matter and the printed matter stage may be aligned.

In an exemplary embodiment of the present application, in the aligning step, a region to be printed of the printed matter may be aligned using a position control portion provided on the printed matter stage.

The precision of the pattern printed by the printing method according to an exemplary embodiment of the present application corresponds to the precision of the alignment. The pattern printed by the printing method according to an exemplary embodiment of the present application may have a precision within an error range of 1 mm or less, specifically, 0.5 mm or less.

The printing step in an exemplary embodiment of the present application may include: coating a printing matter on a printing roll; forming a printing matter pattern on a printing roll by bringing the printing roll on which the printing matter is coated in contact with a cliché; and transferring the printing matter pattern coated on the printing roll on the printed matter.

It is understood by a person with ordinary skill in the art to which the present application pertains that various applications and modifications may be made within the scope of the present application based on the contents.

Although the specific part of the present application has been described in detail, it is obvious to those skilled in the art that such a specific description is just a preferred embodiment and the scope of the present application is not limited thereto. Thus, the substantial scope of the present application will be defined by the appended claims and equivalents thereto.

DESCRIPTION OF REFERENCE NUMERALS

10: Coating portion
20: Printing roll stage
21: Blanket
22: Printing matter
30: Cliché stage
31: Cliché
32: Printing matter pattern
40: Printed matter
41: Printing matter pattern
42: Printed matter stage
50: Position control portion
62: Porous plate
64: Porous film
70: Vacuum suction portion
72: Vacuum hole
74: Vacuum passage
100: Apparatus for fixing a printed matter
110: Engraved portion
122: Vacuum hole
124: Vacuum passage

The invention claimed is:

1. A reverse offset printing device comprising:
a fixing apparatus fixing a printed substrate, and comprising a plurality of engraved portions which are capable of fixing a plurality of printed substrates; and at least one vacuum hole or vacuum passage provided at a lower portion of the engraved portion;
a printed substrate stage on which the fixing apparatus is capable of being fixed;
a cliché comprising a pattern portion corresponding to a transferred pattern position on a printed substrate which is fixed on the fixing apparatus; and
a cliché stage.

2. The reverse offset printing device of claim 1, wherein four or more of the engraved portion are present.

3. The reverse offset printing device of claim 1, wherein the engraved portion is disposed at an upper portion of the fixing apparatus, and is formed such that the printed substrate is arranged and installed.

4. The reverse offset printing device of claim 1, wherein the engraved portion includes a projection or groove for fixing the printed substrate at the inner side thereof.

5. The reverse offset printing device of claim 1, wherein a depth of the engraved portion is equal to or smaller than a thickness of the printed substrate.

6. The reverse offset printing device of claim 1, wherein a depth deviation of the engraved portion is 100 μm or less.

7. The reverse offset printing device of claim 1, wherein printed the substrate is glass substrate or plastic substrate.

8. The reverse offset printing device of claim 1, wherein the printed substrate stage comprises a vacuum suction portion corresponding to a vacuum hole or a vacuum passage provided in the fixing apparatus.

9. The reverse offset printing device of claim 8, wherein the vacuum suction portion of the printed substrate stage comprises a hole structure or a passage structure.

10. The reverse offset printing device of claim 8, wherein the printed substrate stage is provided with a porous plate or a porous film on the vacuum suction portion.

11. The reverse offset printing device of claim 1, wherein the printed substrate stage further comprises a position control portion for aligning the printed substrate.

12. A reverse offset printing method using a printing device comprising:
fixing a printed substrate to an engraved portion of a fixing apparatus fixing the printed substrate;
mounting the fixing apparatus on a printed substrate stage;
coating a printing matter on a printing roll;
forming a printing matter pattern on the printing roll by bringing the printing roll on which the printing matter is coated in contact with a cliché on a cliché stage; and
transferring the printing matter pattern coated on the printing roll on the printed substrate.

13. The reverse offset printing method of claim 12, further comprising:
after mounting the fixing apparatus on a printed substrate stage;
vacuum adsorbing the fixing apparatus and the printed matter stage.

14. The reverse offset printing method of claim 12, wherein the printing method is a reverse offset printing method.

15. The reverse offset printing method of claim 12, further comprising:
aligning the fixing apparatus and the printed substrate stage after mounting the fixing apparatus on the printed substrate stage.

16. The reverse offset printing method of claim 15, wherein in the aligning, a region to be printed of the printed substrate is aligned using a position control portion provided on the printed substrate stage.

17. The reverse offset printing method of claim 15, wherein a precision of the pattern printed by the printing method corresponds to a precision of the alignment.

* * * * *